US006401371B2

(12) United States Patent
Martorella

(10) Patent No.: US 6,401,371 B2
(45) Date of Patent: Jun. 11, 2002

(54) DESKTOP PEN, EYEGLASS AND PICTURE FRAME HOLDER

(76) Inventor: Rudolph Martorella, 2 Spruce St., Apt. 4A, Great Neck, NY (US) 11021

( * ) Notice: Subject to any disclaimer, the term of this patent is extended or adjusted under 35 U.S.C. 154(b) by 0 days.

(21) Appl. No.: 09/735,036

(22) Filed: Dec. 12, 2000

Related U.S. Application Data

(63) Continuation-in-part of application No. 09/620,514, filed on Jul. 20, 2000.

(51) Int. Cl.[7] ..... B43M 17/00; A47G 1/06

(52) U.S. Cl. ..... 40/358; 40/725; 211/85.1; 248/902

(58) Field of Search ..... 40/358, 725; 211/85.1, 211/69.1, 85.31, 181.1; 248/153, 175, 902; D6/301, 313, 462; D19/77, 81

(56) References Cited

U.S. PATENT DOCUMENTS 1,579,978 A * 4/1926 Vincia ..... 211/50
D152,254 S * 1/1949 Gallo ..... D8/371
2,914,185 A * 11/1959 Le Vay ..... 211/60.1
3,550,890 A * 12/1970 Kemp ..... 248/206.4
4,768,298 A * 9/1988 Polhemus et al. ..... 40/358
5,593,045 A * 1/1997 Eldon, III et al. ..... 211/85.1
5,735,075 A * 4/1998 Honkawa et al. ..... 40/645 X
D406,958 S * 3/1999 Baldwin et al. ..... D6/462
D417,566 S * 12/1999 Baldwin et al. ..... D6/462
D440,400 S * 4/2001 Baldwin et al. ..... D3/266

FOREIGN PATENT DOCUMENTS

GB 817019 * 7/1959 ..... 211/181.1

* cited by examiner

*Primary Examiner*—Brian K. Green
(74) *Attorney, Agent, or Firm*—Collard & Roe, P.C.

(57) ABSTRACT

An eyeglass holder and desk frame which provides an area to hold eyeglasses as well as hollow tubes to store pens, a storage cup, and a frame to hold pictures. More specifically, the eyeglass holder and desk organizer provides a hook and frame on which to place an eyeglass as well as clear plastic sections held within the wire frame in which to place pictures. There is also a slot, attached to the base, wherein the slot is designed to hold a series of business cards within the slot.

7 Claims, 10 Drawing Sheets

DESKTOP PEN, EYEGLASS AND PICTURE FRAME HOLDER

CROSS REFERENCE TO RELATED APPLICATIONS

This is a continuation-in-part of U.S. patent application Ser. No. 09/620,514, filed on Jul. 20, 2000, now pending and benefit is claimed under 35 U.S.C. §120.

BACKGROUND OF THE INVENTION

Field of the Invention

The invention relates to an eyeglass holder and desk organizer. Specifically, the present invention provides a wire frame which provides an area to hold eyeglasses as well as hollow tubes to store pens, a storage cup or tray and a frame to hold pictures. More specifically, the eyeglass holder and desk organizer provides a hook and frame on which to place eyeglasses as well as clear plastic sections held within the wire frame in which to place pictures.

SUMMARY OF THE INVENTION

The invention relates to an eyeglass holder and desk organizer that stores eyeglasses when they are not being used. The bridge of the glasses is placed on a hook extending from the center of the wire frame. The glasses remain in their open position and the arms extend back into the wire frame of the organizer. These glasses rest upon a cross bar segment of the frame. A logo or symbol may be placed on a flat piece that is connected to the hook that holds the eyeglasses.

The wire frame has a large rectangular base section which allows the structure to stand upright when in use. Attached to the wire frame base structure are two hollow tubular pieces. The higher ends of these pieces are open while the lower ends are closed. These tubular pieces are used to hold pens or pencils on the desk. Located above the base section and behind the central hook is a storage container. If the glasses were in place on the structure, this container would be located behind the bridge of the glasses and between its arms extending back to the wire frame of the organizer.

The storage container or tray is held in place by two semicircular wire sections. Both of these sections extend outward from the main body of the wire frame. The first semicircular wire section supports the storage container from below and allows the storage container to rest upon it. The second semicircular wire section encircles the upper portion of the storage container holding it in place. The storage container also may have a wall within it providing for two separate storage areas.

A picture frame is located at the top-most portion of the eyeglass holder and desk organizer. Two parallel wire arms extend upward from the wire frame structure. The picture is held between these two arms. Two flat plastic pieces fit together in order to hold the picture in place. The flat plastic pieces when attached are slid between the two parallel wire arms and the picture is held in place. Each arm is composed of two parallel wires. The two flat plastic pieces fit between the two wires in each of the arms to hold the picture more securely.

In addition, in a second embodiment of the invention, extension bars are attached to the wire frame, wherein these extension bars are designed to create a substantially rectangular opening. This substantially rectangular opening is designed to receive business cards.

BRIEF DESCRIPTION OF THE DRAWINGS

Other objects and features of the present invention will become apparent from the following detailed description considered in connection with the accompanying drawings which disclose two embodiments of the present invention. It should be understood, however, that the drawings are designed for the purpose of illustration only and not as a definition of the limits of the invention.

DETAILED DESCRIPTION OF THE PREFERRED EMBODIMENT

Figure 1:
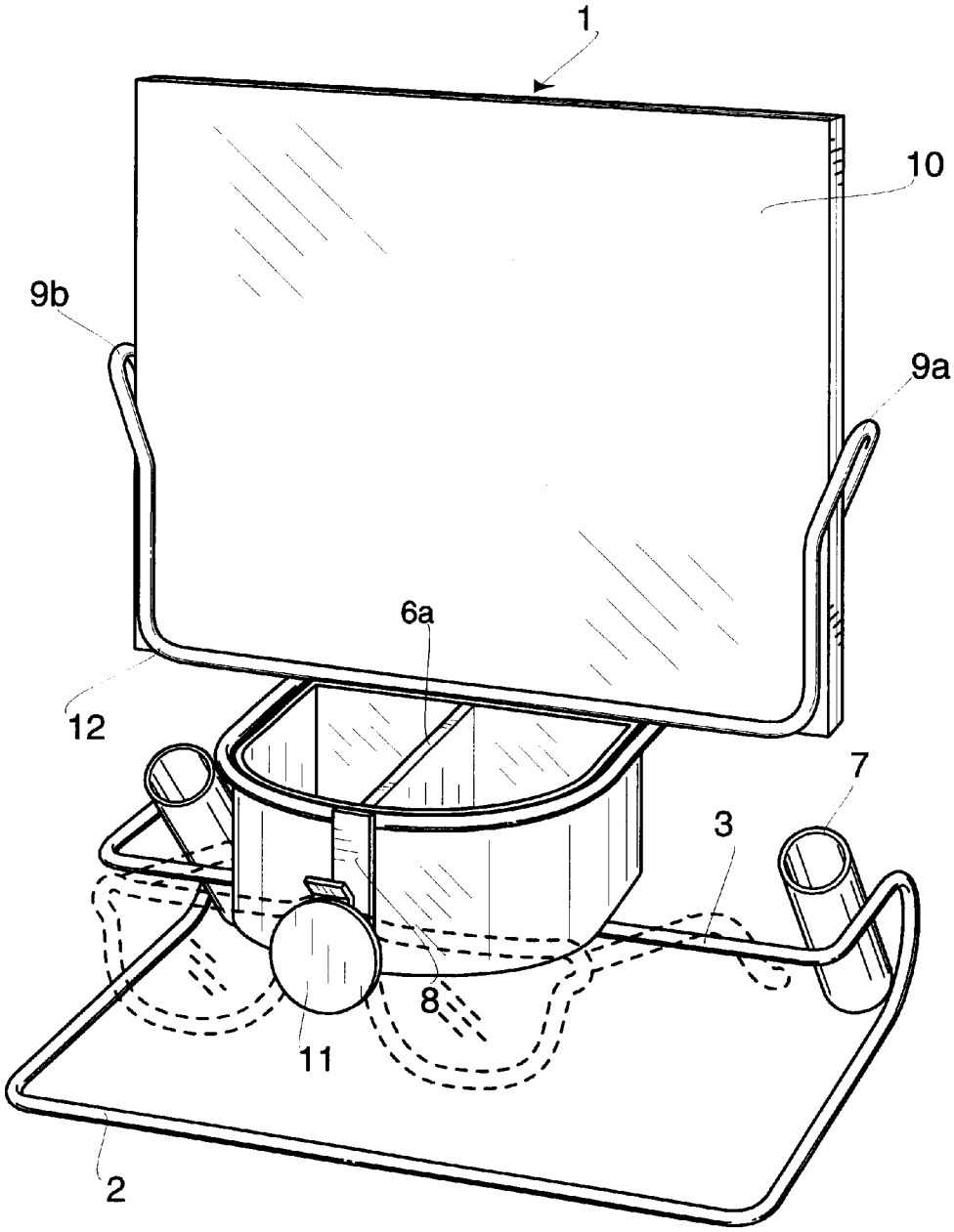
FIG. 1 shows a perspective view of the eyeglass holder and picture frame support.
Figure 2:
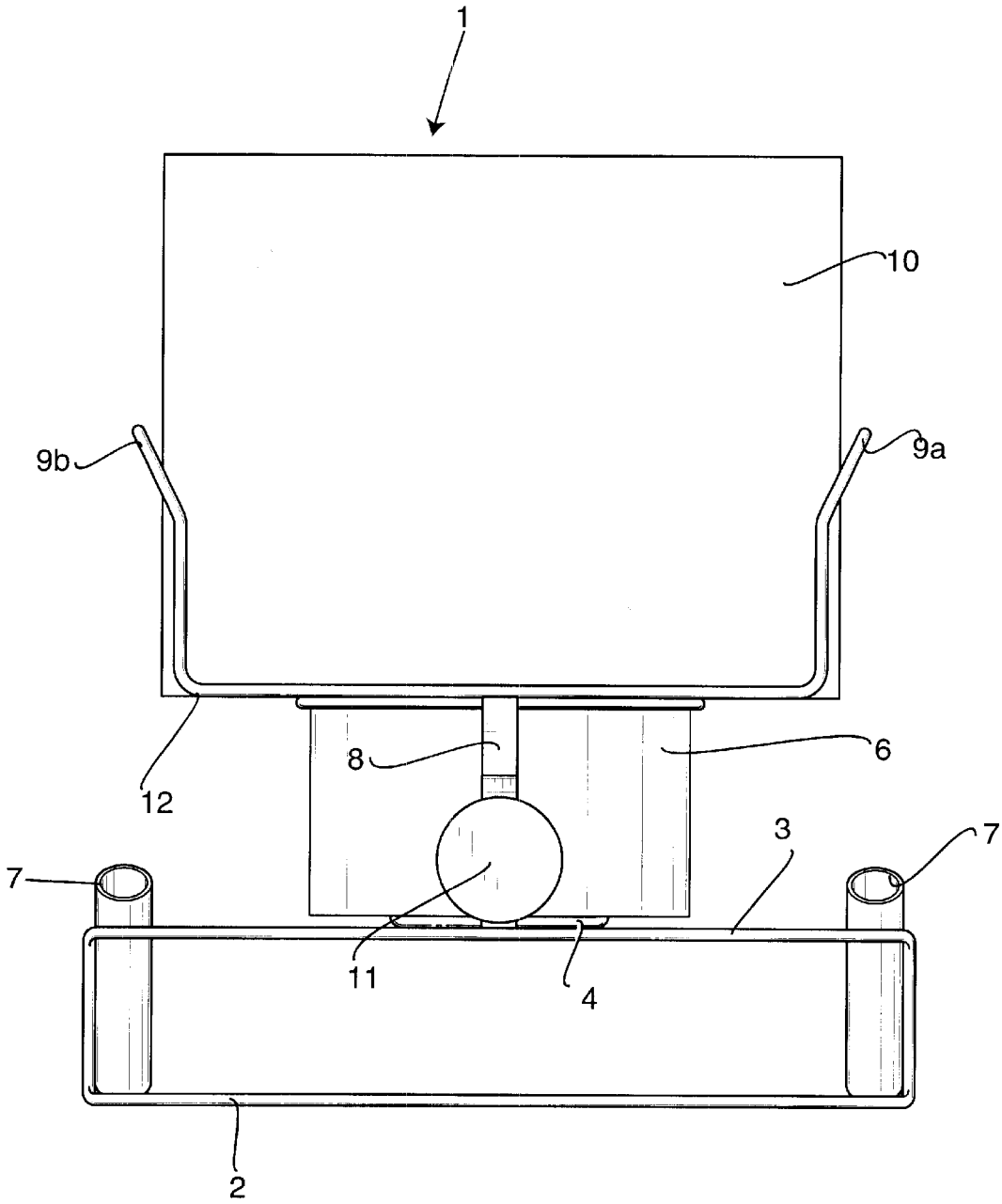
FIG. 2 shows a front view of the eyeglass holder and picture frame support.
Figure 3:
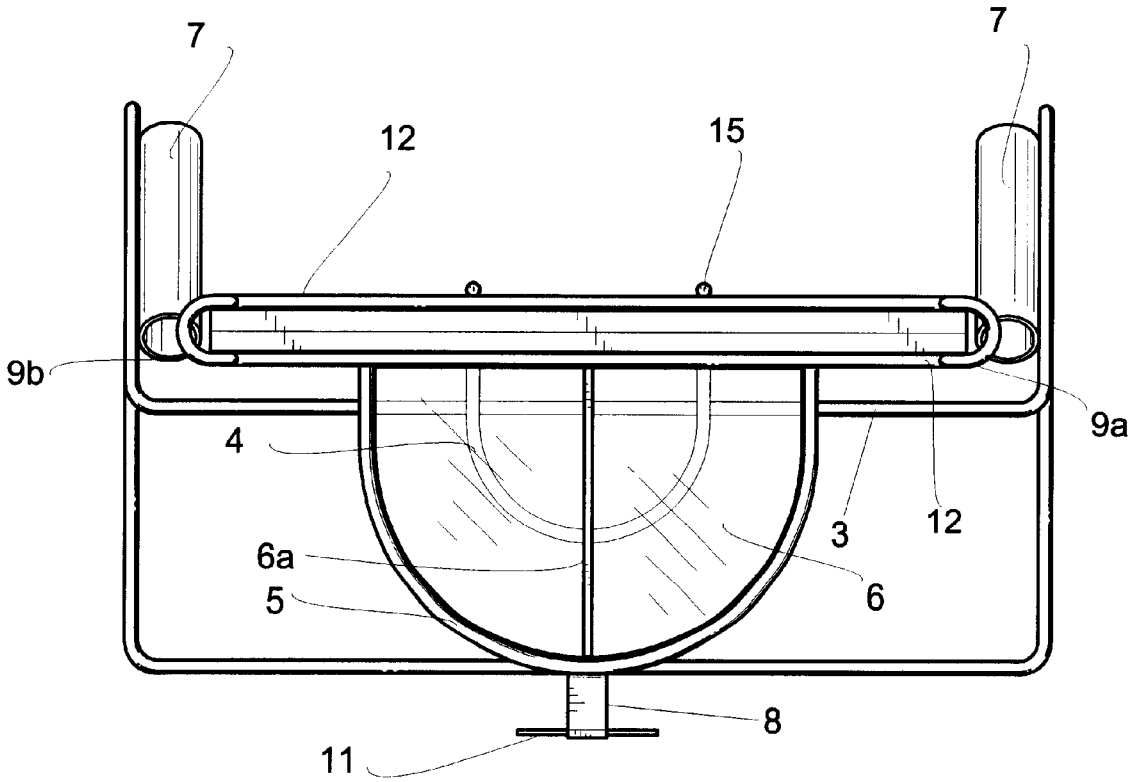
FIG. 3 shows a top view of the eyeglass holder and picture frame support.

Referring in detail to drawings, FIGS. 1–6 show a first embodiment of the desktop eyeglass holder and picture frame support 1. Desktop eyeglass holder and picture frame support 1 has a rectangular wire base 2 that allows support 1 to stand upright. Wire base 2 is connected to wire cross bar 3 which extends the width of support 1. Directly above wire cross bar 3 are wire cross bars 12 shown in greater detail in FIG. 3. As shown in FIG. 2, semicircular wire section 4 extends outward from the center of wire cross bar 3, Larger semicircular wire section 5 extends outward from the center of wire cross bars 12. There is also a semicircular cupped storage container or tray 6 which is encircled by larger semicircular wire section 5 and rests upon semicircular wire section 4 wherein wire sections 4 and 5 serve as a holder for container 6. Semicircular cupped container 6 may be used to store and organize desk items. A plastic dividing wall **6*a* may also be placed in semicircular cupped container 6 to provide two separate storage areas. In this way, a user could place both gum drops or other perishables in one side of the container 6, while placing thumb tacks in the other section of container 6. Thus, the gum drops would be kept separate from the thumb tacks via dividing wall 6*a***.

Hooked segment 8 extends downward from the front of larger semicircular wire section 5 and forms an eyeglass frame holder for holding eyeglasses shown as dashed lines. When a pair of eyeglasses are not in use, the bridge of the eyeglasses may be placed on U-shaped hook segment 8. The arms of the eyeglasses remain open and their ends rest upon wire cross bar 3. Flat surface 11 may be attached to the front of hooked segment 8 to display a logo or symbol on desktop eyeglass holder and picture frame support 1.

Two arms **9*a* and 9*b* extend upward from the ends of wire cross bar 12. These two arms 9*a* and 9*b* consist of two parallel wire segments. Two flat clear plastic pieces 10 are disposed between arms 9*a* and 9*b*. These two flat clear plastic pieces 10 snap together and also fit between the two parallel wire segments of each arm 9*a* and 9*b*. When in place, flat clear plastic pieces 10 also fit between the bars of wire cross bars 12. Two flat clear plastic pieces 10 may be removed from between arms 9***a* and 9*b* and separated to insert a picture. Once the picture is placed between two flat clear plastic pieces 10 these two clear plastic pieces are re-connected and then inserted back between arms 9*a* and 9*b*.

Two hollow tubular sections 7, which are used as pen holders, are attached to the wire frame structure. More specifically, tubular pen holders 7 are connected to wire base section 2 and wire cross bar 3. Hollow tubular pen holders 7 are open on their higher end and closed on their lower end. Tubular pen holders 7 are used so that pens and pencils can be easily removed from, or inserted into these pen holders 7.

Figure 4:
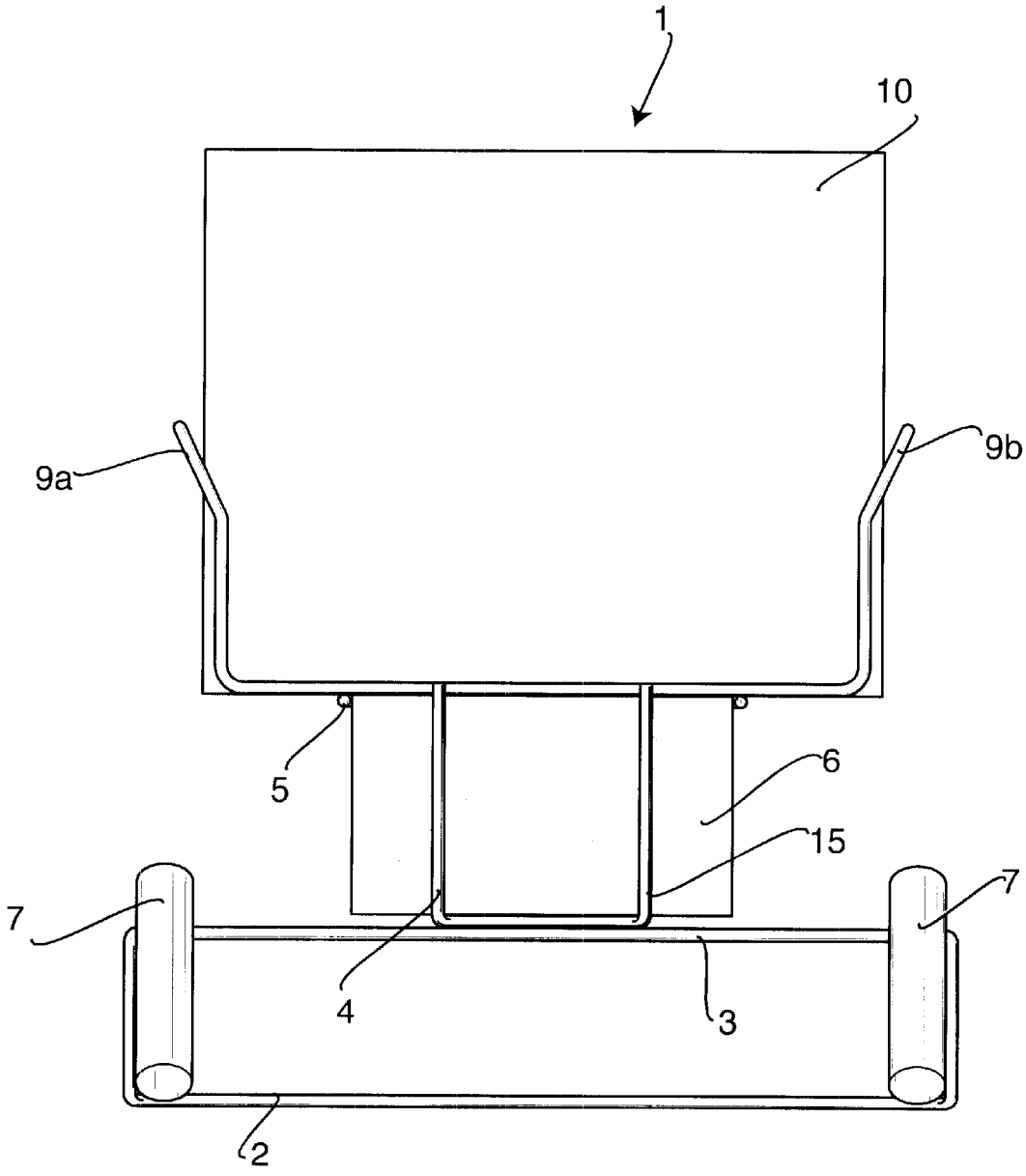
FIG. 4 shows a rear view of the eyeglass holder and picture frame support.
Figure 5:
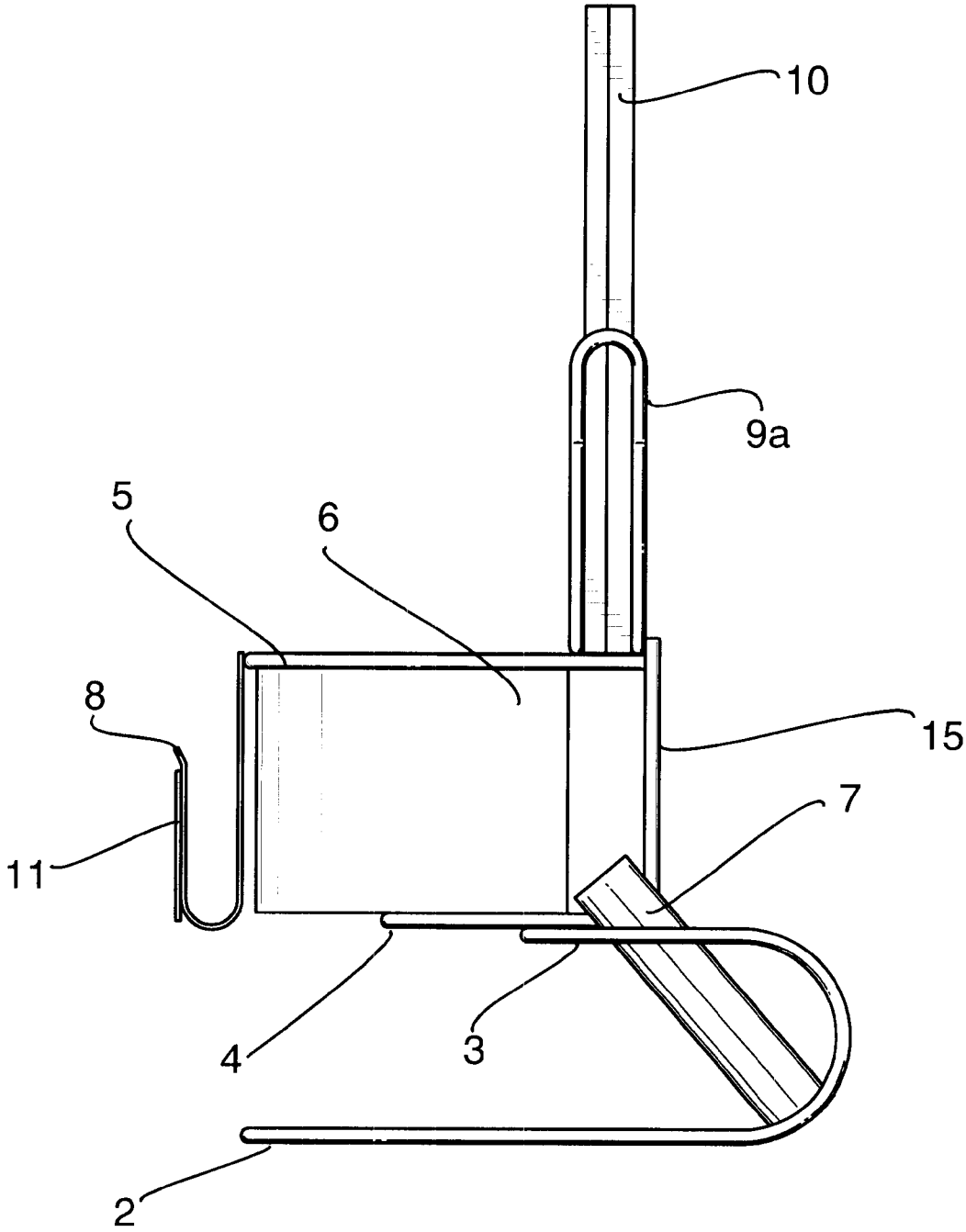
FIG. 5 shows a side view of the eyeglass holder and picture frame support.
Figure 6:
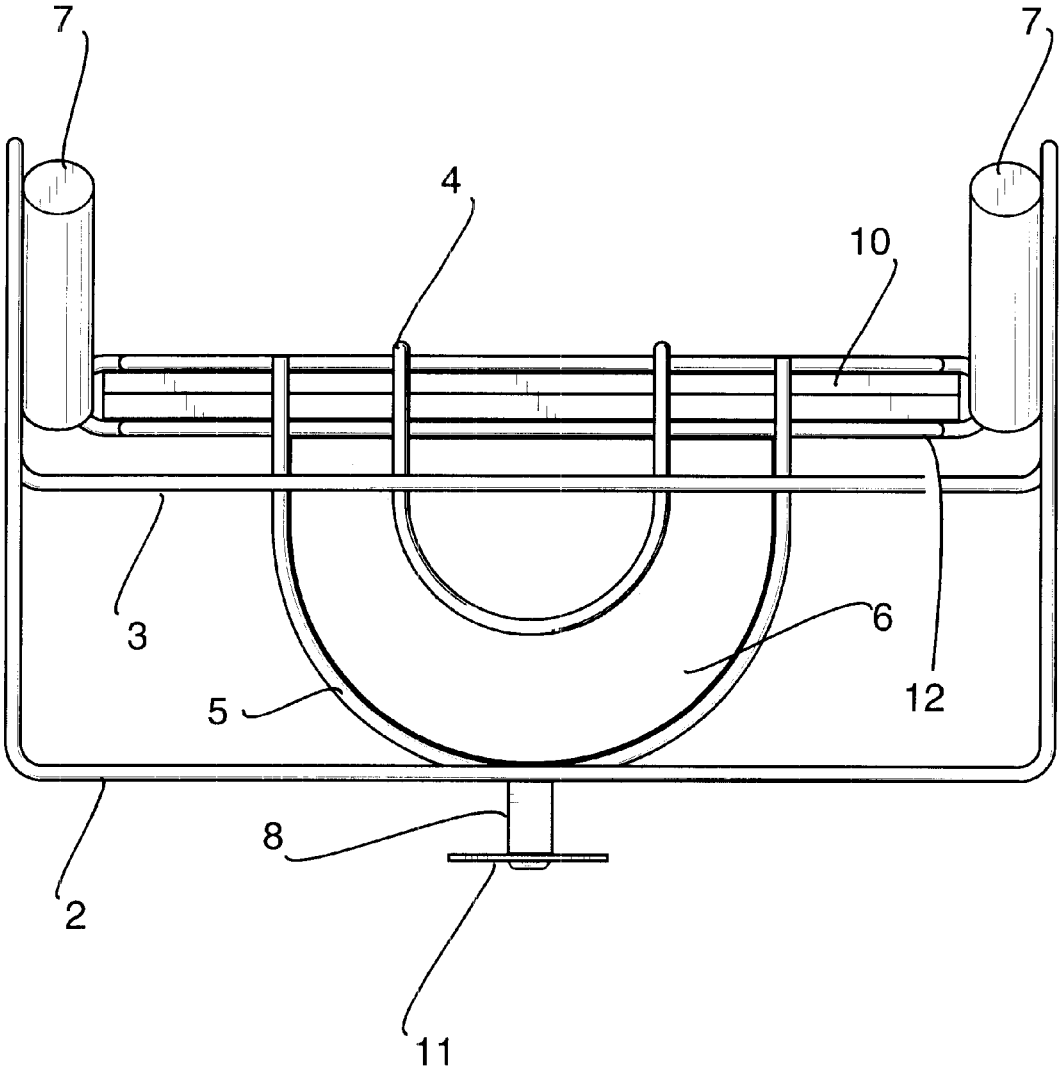
FIG. 6 shows a bottom view of the eyeglass holder and picture frame support.

FIG. 4 shows a back view of holder 1 wherein there is shown a series of vertically extending support bars 15 that are connected to semi circular wire section 4 for supporting container 6. As shown in FIGS. 4, 5, and 6 the wire frame support is designed to connect pen holders 7, U-shaped hook segment 8 for supporting eyeglasses and arms 9*a* and 9*b* for supporting a picture frame all in one, single piece.

For example, FIG. 5 shows a side view of frame 1, wherein there is shown wire cross bar 3 being connected to a first semi-circular wire section 4. In addition, vertically extending support bars 15 connect to wire section 4 and extend up to a second semi-circular wire section 5. Semi-circular wire section 5 extends out to hooked segment 8 which connects to flat surface 11.

Wire cross bar 3 also connects to hollow tubular sections 7 in two places so that hollow tubular sections 7 remain angled up to receive pens, pencils and other tubular shaped objects. In addition, arms 9*a* and 9*b* connect to semi-circular wire section 5, and to vertically extending support bars 15. Clear plastic pieces 10 and semicircular cupped container or tray 6 can then be inserted into this one piece wire frame.

Figure 7:
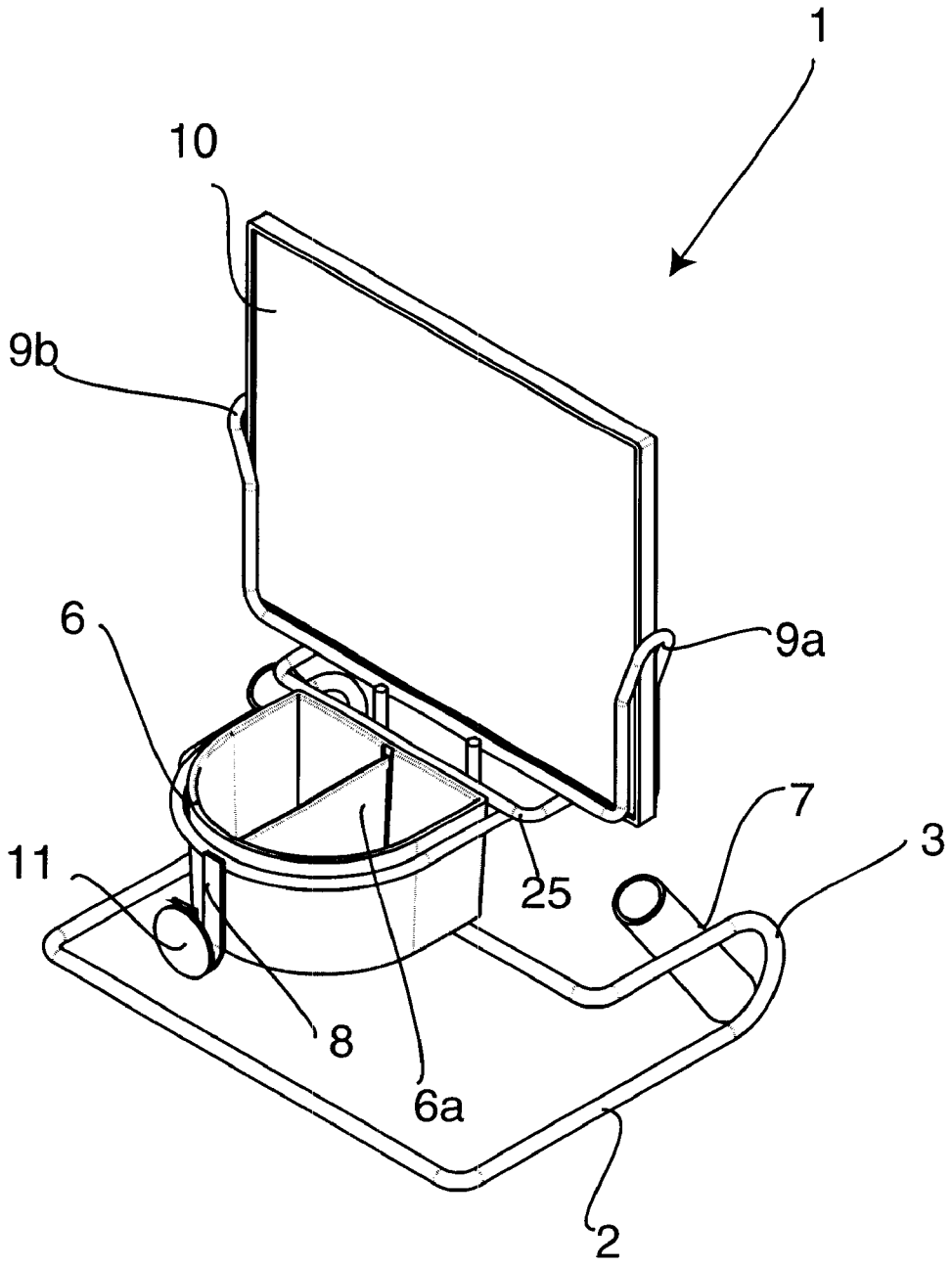
FIG. 7 shows a perspective view of the second embodiment of the invention.

FIG. 7 shows a perspective view of the second embodiment of the invention. With this embodiment, there is shown an additional set of extension bars 25. Extension bars 25 are designed so that they create a slot 27 which allows business cards to be placed therein. In essence, extension bars 25 create a separation between clear plastic pieces 10 and the remaining portion of frame 1.

Figure 8:
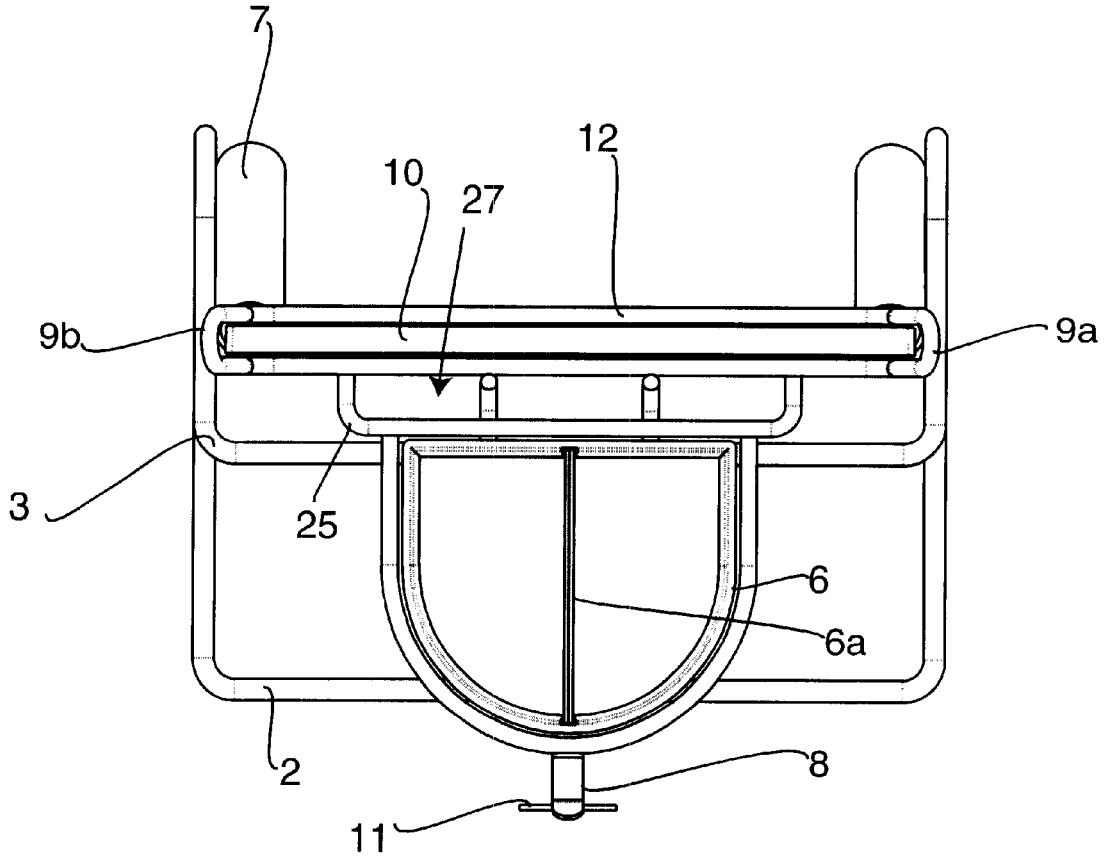
FIG. 8 shows a top view of the second embodiment of the invention.
Figure 9:
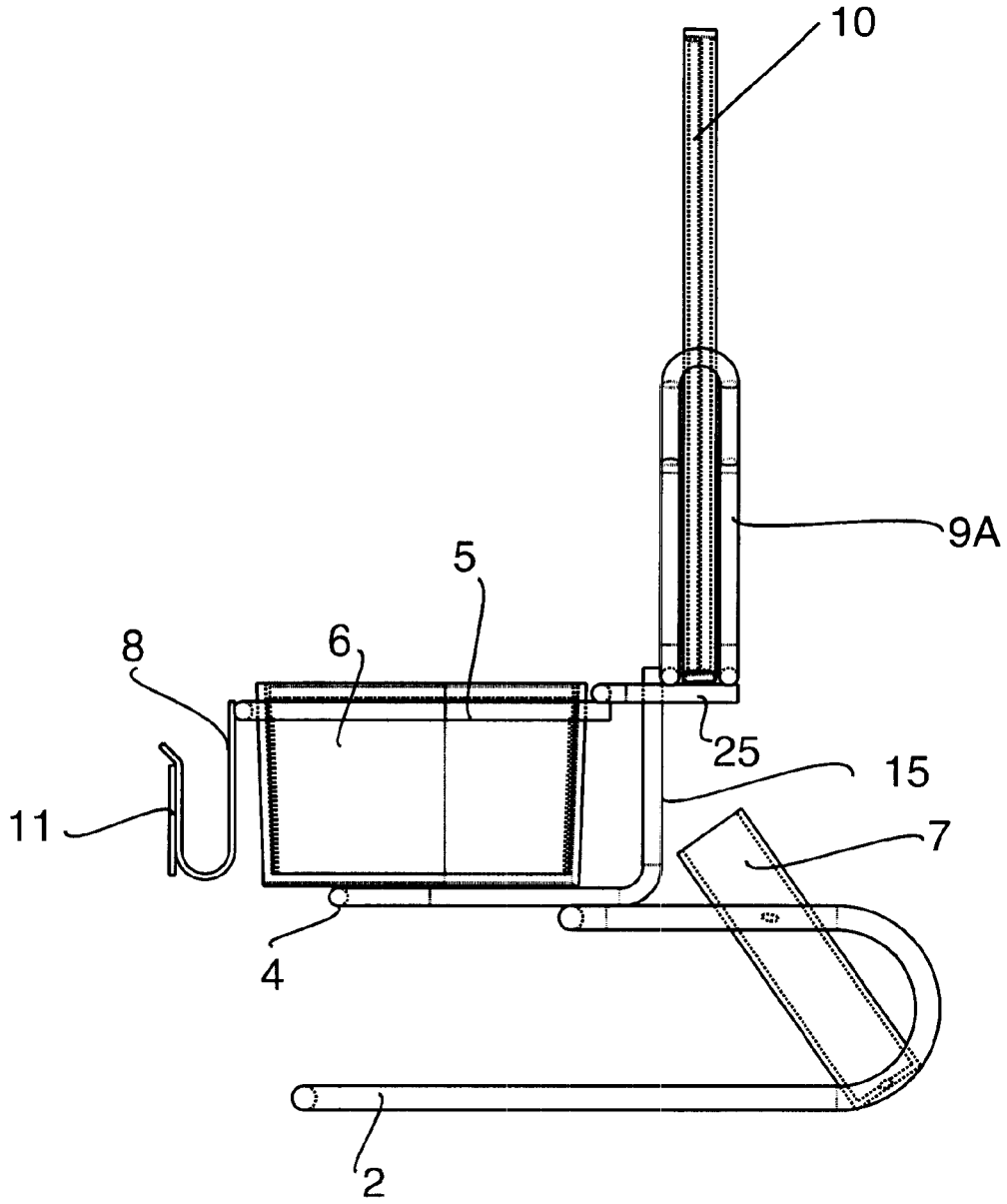
FIG. 9 shows a side view of the second embodiment of the invention.

In addition, FIG. 8 shows the top view of the second embodiment of the invention, showing extension bars 25 creating a substantially rectangular slot 27 for placing business cards therein. This substantially rectangular slot 27 is designed so that it has sufficient depth (See FIG. 9) to allow approximately 20 business cards to be placed therein.

Figure 10:
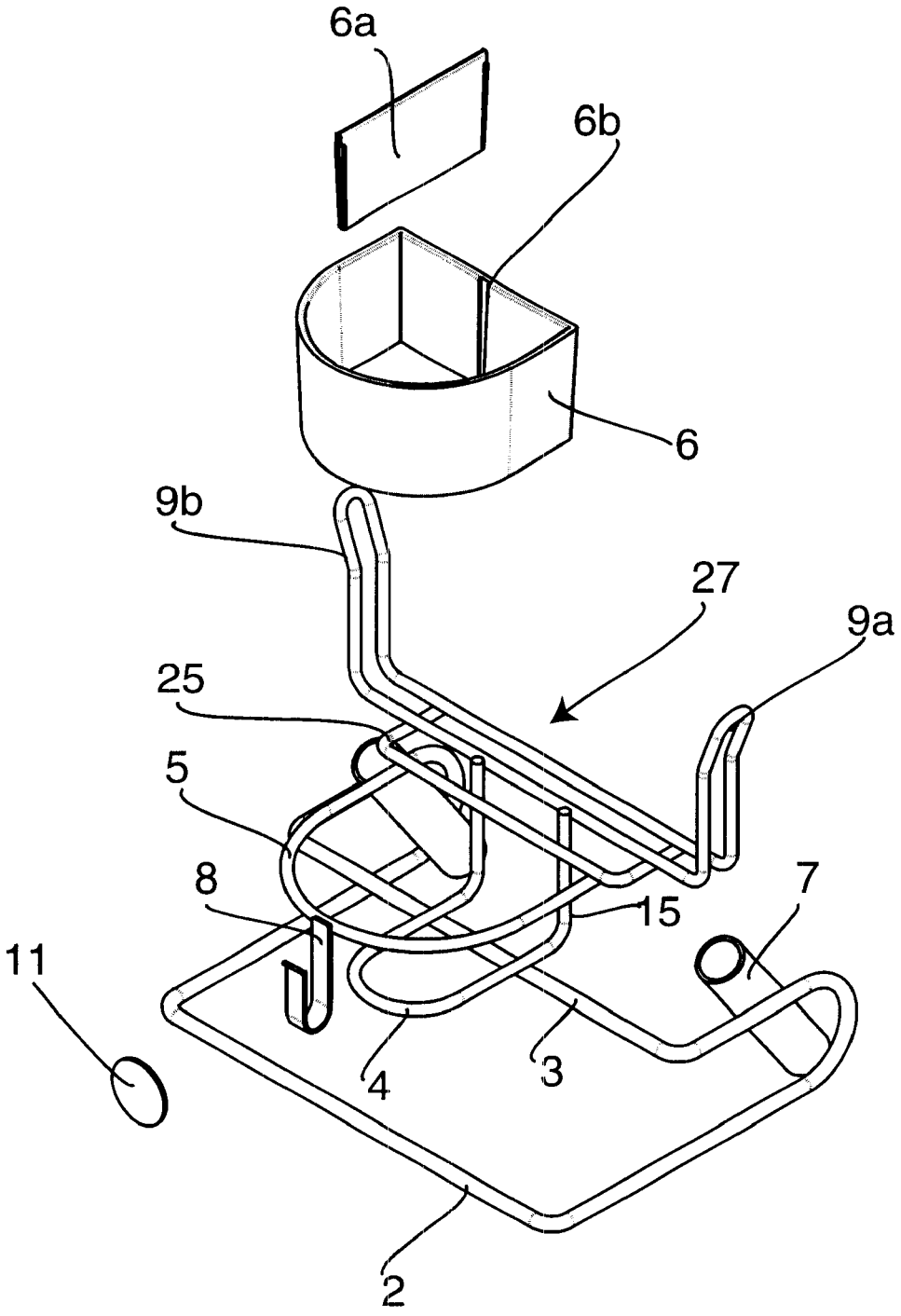
FIG. 10 shows an exploded perspective view of the second embodiment of the invention.

FIG. 10 shows an exploded perspective view of frame 1. With this view, dividing wall 6*a* is shown pulled out of semicircular cupped container or tray 6. With this design, dividing wall 6*a* can be inserted into, or removed from container or tray 6 via slots 6*b*. Slots 6*b* are designed so that they receive dividing wall 6*a* in a snug manner to hold dividing wall 6*a* tight within container 6.

Accordingly, while two embodiments of the present invention has been shown and described, it is obvious that many changes and modifications may be made thereunto without departing from the spirit and scope of the invention.

What is claimed is:

1. A support device comprising:

a) a wire frame comprising:

i) a base section;

ii) a container holder, coupled to said base section, said container holder comprising a plurality of parallel extending wire sections that extend substantially horizontal when said base section is placed on a desk;

iii) at least one picture frame support, coupled to said base section, said at least one picture frame support comprising a plurality of parallel extending wire sections that extend substantially vertical when said base section is placed on said desk; and iv) at least one business card holder, coupled to said base section, comprising at least one u-shaped wire section extending substantially horizontal forming a slot, and at least one wire section extending underneath said u-shaped wire section so that said slot is bound on its sides and bottom by said wire frame, wherein said business card holder is disposed adjacent to said at least one picture frame support;

b) at least one clip, coupled to said wire frame, said at least one clip for allowing a bridge on a pair of eyeglass frames to snap therein; and c) a plurality of pen holders coupled to said wire frame.

2. The device as in claim 1, wherein said at least one business card holder is coupled to said those section.

3. The device as in claim 1, wherein said at least one clip is coupled to said container holder.

4. The device as in claim 1, further comprising a container disposed within said container holder.

5. The device as in claim 4, further comprising a divider disposed within said container for dividing said container into two separate regions.

6. The device as in claim 1, further comprising a picture frame disposed inside of said at least one picture frame support.

7. The device as in claim 1, further comprising at least one first surface coupled to said at least one clip.

* * * * *